US005488210A

United States Patent [19]

Shigetaka et al.

[11] Patent Number: 5,488,210

[45] Date of Patent: Jan. 30, 1996

[54] PUSH BUTTON SWITCH

[75] Inventors: Hiroshi Shigetaka; Yasuhide Orita, both of Iwaki, Japan

[73] Assignee: Alps Electric Co., Ltd., Tokyo, Japan

[21] Appl. No.: 390,266

[22] Filed: Feb. 16, 1995

Related U.S. Application Data

[63] Continuation of Ser. No. 69,891, Jun. 1, 1993, abandoned.

[30] Foreign Application Priority Data

| | | | |
|---|---|---|---|
| Jun. 11, 1992 | [JP] | Japan | 4-152163 |
| Jul. 16, 1992 | [JP] | Japan | 4-189444 |
| Aug. 4, 1992 | [JP] | Japan | 4-208116 |
| Sep. 1, 1992 | [JP] | Japan | 4-233792 |

[51] Int. Cl.[6] ..... H01H 3/12

[52] U.S. Cl. ..... 200/344

[58] Field of Search ..... 200/517, 520, 200/329, 341, 342, 344, 345; 400/490, 491, 491.1, 491.2, 491.3, 495, 495.1, 496

[56] References Cited

U.S. PATENT DOCUMENTS

| | | | |
|---|---|---|---|
| 1,232,793 | 7/1917 | Grimes . | |
| 3,144,270 | 8/1964 | Bilancia . | |
| 3,292,761 | 12/1966 | Erpel . | |
| 3,711,685 | 1/1973 | Castle . | |
| 3,720,801 | 3/1973 | Yanaga . | |
| 3,741,512 | 6/1973 | Olsson . | |
| 3,771,636 | 11/1973 | Kerns, Jr. . | |
| 3,787,837 | 1/1974 | Allen et al. . | |
| 3,916,150 | 10/1975 | Abernethy et al. . | |
| 3,940,578 | 2/1976 | Pointon . | |
| 3,962,556 | 6/1976 | Kravchuck . | |
| 4,010,838 | 3/1977 | Sims, Jr. . | |
| 4,343,557 | 8/1982 | DuRoss et al. . | |
| 4,367,380 | 1/1983 | Larson et al. . | |
| 4,384,796 | 5/1983 | Denley . | |
| 4,392,037 | 7/1983 | Fleming . | |
| 4,412,754 | 11/1983 | Sparks . | |
| 4,433,225 | 2/1984 | Cowles . | |
| 4,453,198 | 6/1984 | Bush et al. . | |
| 4,454,562 | 6/1984 | Bush et al. . | |
| 4,580,022 | 4/1986 | Oelsch et al. . | |
| 4,902,862 | 2/1990 | Oelsch et al. . | |
| 5,278,372 | 1/1994 | Takagi et al. | 200/344 |
| 5,278,374 | 1/1994 | Takagi et al. | 200/344 X |
| 5,280,147 | 1/1994 | Mochizuki et al. | 200/344 |

FOREIGN PATENT DOCUMENTS

| | | |
|---|---|---|
| 046575 | 3/1982 | European Pat. Off. . |
| 2309367 | 9/1974 | France . |
| 2008322 | 12/1978 | Germany . |
| 4-51388 | 12/1992 | Japan . |
| 5-66838 | 9/1993 | Japan . |
| 5-66836 | 9/1993 | Japan . |

OTHER PUBLICATIONS

R. H. Harris, "Self–Biasing Space Bar Stabilizer Mechanism" *IBM Technical Disclosure Bulletin,* vol. 21 No. 9, Feb., 1979.

*Primary Examiner*—Renee S. Luebke
*Attorney, Agent, or Firm*—Guy W. Shoup; Patrick T. Bever

[57] ABSTRACT

A push button switch including a key top supported on first and second crossed arm members, each arm member including a first shaft provided at one end and rotatably connected to the key top and protrusions provided at the other end and slidably rotatably received in receiving slots formed in a baseplate. The first and second arm members are joined at central portions thereof such that when the key top is pressed toward the baseplate, the first and second arm members collapse into a common plane. The first and second arm members include parallel legs respectively connected to opposite ends of the first and second shafts, and one of the first and second arm members includes a centrally-disposed manipulating member extending to contact an upper surface of an elastic member, the elastic member being positioned over a switch mechanism. The key top is supported such that it is movable up and down while remaining parallel to the baseplate.

9 Claims, 11 Drawing Sheets

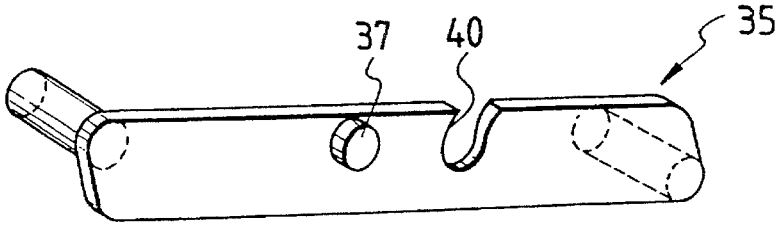
FIG. 16(a)
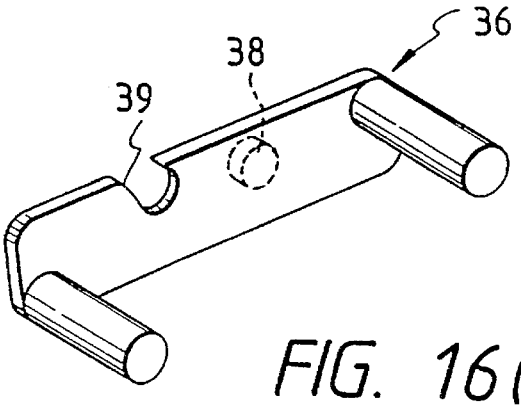
FIG. 16(b)
FIG. 18
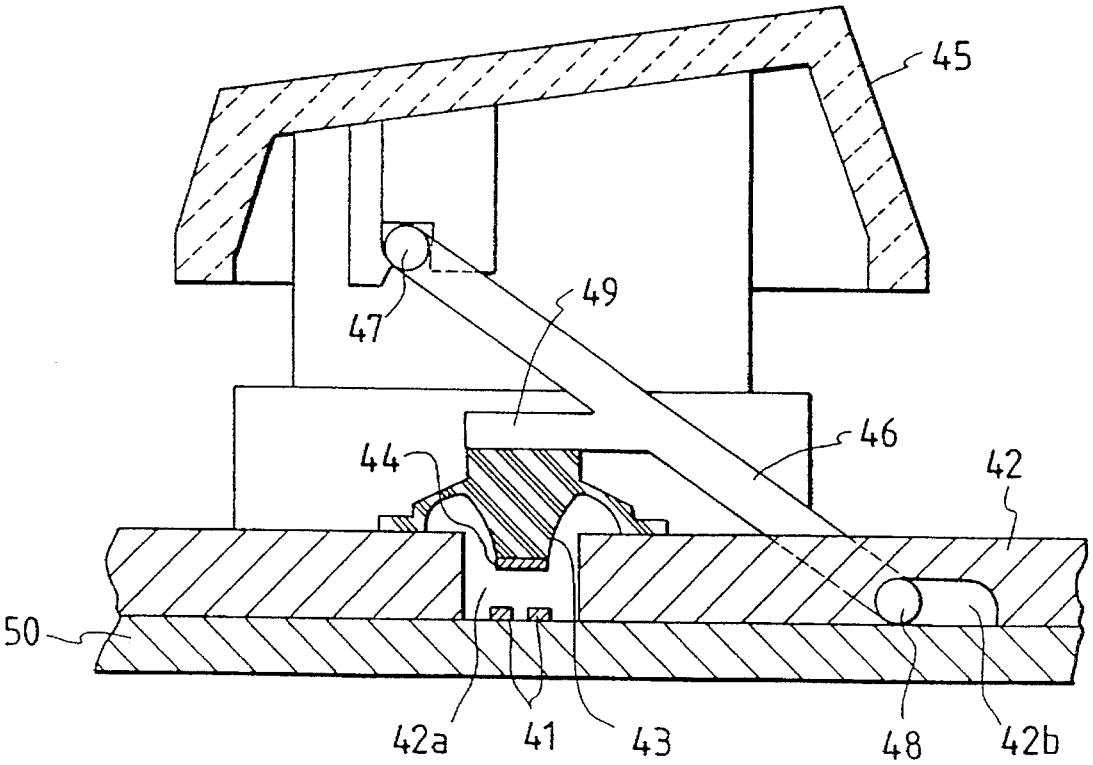

PUSH BUTTON SWITCH

BACKGROUND OF THE INVENTION

This application is a continuation of application Ser. No. 08/069,891, filed Jun. 1, 1993, and now abandoned.

FIELD OF THE INVENTION

The present invention relates generally to a push button switch used as a key switch of a keyboard input device and, more particularly, to a reduced-thickness push button switch suitable for a low-profile keyboard device.

RELATED BACKGROUND ART

With an increase in popularity of low-profile keyboard devices, there has recently been an increased demand for thinner push button switches which can be incorporated into the keyboard devices to reduce the thickness even further.

In a conventional push button switch, a stem is provided on the bottom surface of a key top. The stem is slidably received in a slide cylinder which is mounted on a housing. In addition, an elastic rubber member is provided under the stem for biasing the key top away from the housing. Thus, the key top is movable up and down in the cylinder relative to the housing upon pressing and releasing by an operator.

One way to reduce the height of the conventional push button switch is to shorten the slide cylinder and stem. However, this decreases the amount of stem received in the slide cylinder. As a result, the key top is tilts easily relative to the slide cylinder due to a small amount of clearance between the stem and the slide cylinder, the clearance being is provided to facilitate sliding. That is, when an operator depresses an edge of the key top, the key top is tilted relative to the housing, thereby causing binding (wedging) of the stem against the inner surface of the slide cylinder which prevents a proper up-and-down operation of the key top. Therefore, simply reducing the height of the stem and slide cylinder causes a reduction in the operating quality and degrades the tactile feel of the key switch.

Further, U.S. Pat. Nos. 4,902,862 and 4,580,022 disclose a key switch including both a stem/cylinder arrangement and an X-shaped arm member structure for supporting an L-shaped key top. Based on such a support structure, an upper surface of the L-shaped key top is maintained parallel (i.e., tilting is prevented) by the X-shaped arm member structure. However, because of the stem/cylinder arrangement, it is difficult to reduce the thickness of the push button switch. Further, a support part of the X-shaped arm member connected to the key top is constructed so that a shaft of the X-shaped arm member slides on the bottom surface of the key top. It is therefore difficult to miniaturize the key top and reduce the thickness thereof.

Moreover, there is an increase in the types of equipment which include keyboards. As such, there is an increased demand for a push button switch which not only functions simply as an input unit of the keyboard but also provides a soft tactile feel to the operator; i.e., a push button switch which provides a desirable resistance to pressing force, a reliable stroke and a "clicking" sensation at the bottom of the stroke.

In the conventional push button switch, the biasing force opposing an operator's pressing force is provided by the elastic (rubber) click member. If the biasing force of the elastic click member is reduced to provide a "soft" tactile feel, the operating life-span of the elastic click member becomes short, and a desirable "click" sensation is reduced because buckling does not occur properly. It is therefore difficult to provide the push button switch which functions well in response to a relatively small pressing force.

An additional problem is given as follows. The amount of elastic force and the stroke length in the event of an overstroke after the movable contact has come into a contact with the fixed contact depend on a configuration of the click rubber, These values are hard to arbitrarily set.

It is a primary object of the present invention, which has been devised in view of the foregoing problems inherent in the prior art, to provide a push button switch capable of further reducing the thickness of a keyboard without causing binding of the key top, and to provide a push button switch which exhibits a decreased biasing force while increasing a life-span thereof and providing a reliably uniform tactile feel.

It is another object of this invention is to provide a push button switch which is inexpensive and easy to assemble.

SUMMARY OF THE INVENTION

In accordance with the present invention, a push button switch is provided which eliminates the need for the stem/cylinder arrangement of the prior art, thereby producing a push button switch which has a low profile while maintaining both desirable operation qualities and ease of assembly.

A push button switch according to a first embodiment of the present invention includes a key top adjustably mounted on a support assembly which in turn is mounted on a baseplate. The key top includes two sets of supports formed on a rear surface thereof. The baseplate is formed with two pairs of receiving slots. An elastic member is located between said key top and said baseplate which biases the key top away from the baseplate. A switch element is formed on the baseplate below the elastic member.

The key top support assembly includes an E-shaped member and a U-shaped member. The E-shaped member includes a pair of parallel legs connected at one end by a shaft, and an actuating lever extending from the shaft between the parallel legs. The shaft is pivotally received in one of the supports formed on the key top. A pair of protrusions are formed at a second end of the parallel legs which are slidably and rotatably received in one pair of the receiving slots formed in the baseplate. The E-shaped arm member also includes second projections formed midway between the first and second ends. The U-shaped member similarly includes a shaft and parallel legs extending from the shaft; however, the U-shaped member does not include an actuating lever. The shaft is received in the other of the sets of supports formed on the key top, and protrusions formed at opposite ends of the parallel legs are received in the second pair of grooves formed in the baseplate. Finally, a pair of curved grooves are formed in the legs approximately midway between the shaft and the protrusions. When the E-shaped member and the U-shaped member are connected, the legs of the U-shaped member are received between the legs of the E-shaped member and the second projections of the E-shaped member are received in the curved grooves of the U-shaped member.

When the push button switch is in an "off" state, the elastic member pushes up on the actuating lever of the E-shaped member, thereby forcing the E-shaped member upward. Because the key top is connected to the shaft of the E-shaped member, the key top is also pushed upward, thereby lifting the U-shaped member such that the legs of the E-shaped member form a pair of X-shapes with the legs of the U-shaped member.

When an operator presses the key top downward into an "on" state, the elastic member is buckled by the actuating lever and actuates the switch element. At the same time, the legs of the E-shaped member and the U-shape member are pivoted until they are in a common plane.

With the above-described push button switch, the height of the switch is reduced due to the omission of the prior art stem/cylinder arrangement. Further, because the legs of the U-shaped member and the E-shaped member are pivoted into a common plane, the depressed height of the push button switch is minimized.

Further, the actuating lever acts reduces the required height of the elastic member to one-half of the stroke length of the key top. As such, the elastic member can be made smaller and stronger, thereby assuring a long product life-span. In addition, the force necessary to depress the elastic member is reduced, thereby providing a desired "soft" tactile feel.

Further, the actuating lever exhibits a flexibility which reduces the need for a uniform production of elastic members. That is, elastic members of different heights may be successfully depressed by the actuating lever, with associated stroke differences producing variations in the amount of flexing of the actuating lever. As such, easy assembly is facilitated.

BRIEF DESCRIPTION OF THE DRAWINGS

Other objects and advantages of the present invention will become apparent during the following discussion in conjunction with the accompanying drawings, in which:

FIG. 16 is a perspective view showing a seventh embodiment of the arm members;

FIG. 18 is a sectional view showing an off-state of the push button switch in an eighth embodiment.

DETAILED DESCRIPTION OF PREFERRED EMBODIMENTS

Figure 1:
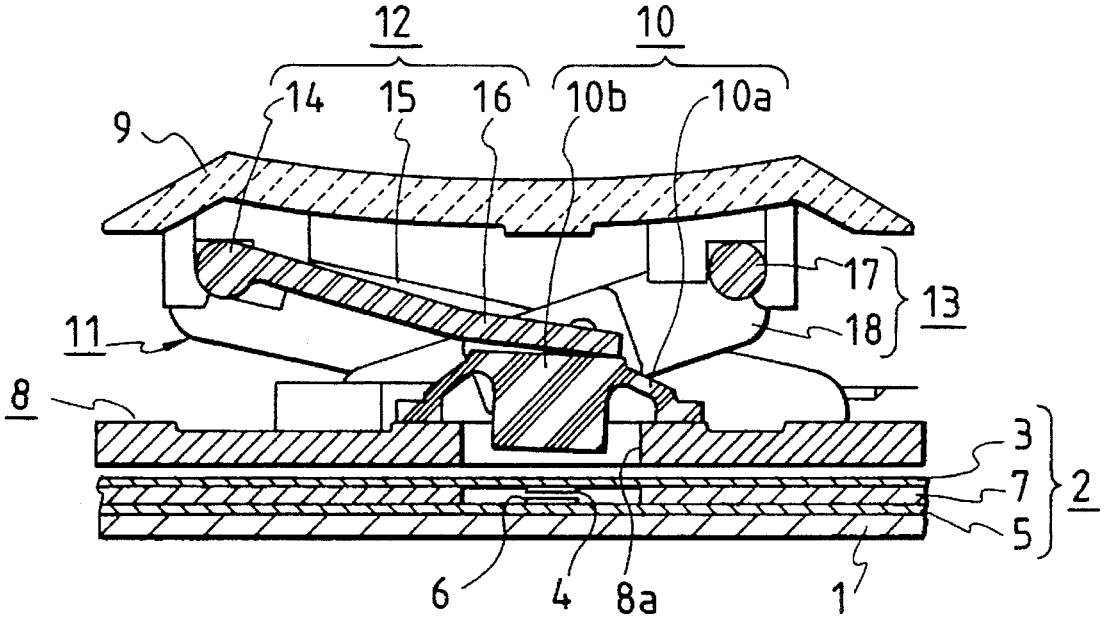
FIG. 1 is a sectional view showing an off-state of a push button switch in one embodiment of the present invention.
Figure 2:
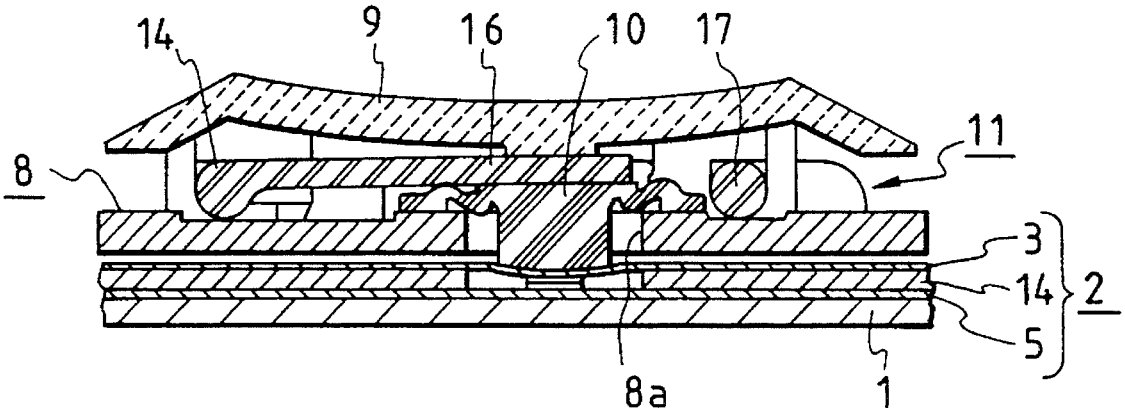
FIG. 2 is a sectional view showing an on-state of the push button switch.

Embodiments of the present invention will hereinafter be described with reference to the drawings. FIG. 1 is a sectional view illustrating an off-state of a push button switch in a first embodiment of this invention. FIG. 2 is a sectional view illustrating an on-state of the push button switch of the first embodiment.

Referring to FIGS. 1 and 2, a second baseplate (support plate) 1 is composed of a hard material such as a metal plate or the like. A membrane sheet switch 2 is mounted on this support plate 1. This membrane sheet switch 2 is a flexible switch element having a movable contact 4 provided on the lower surface of an upper sheet 3. The movable contact 4 is disposed in a face-to-face relationship with a fixed contact 6 provided on the upper surface of a lower sheet 5. A spacer 7 is interposed between the two sheets 3, 5.

Figure 6:
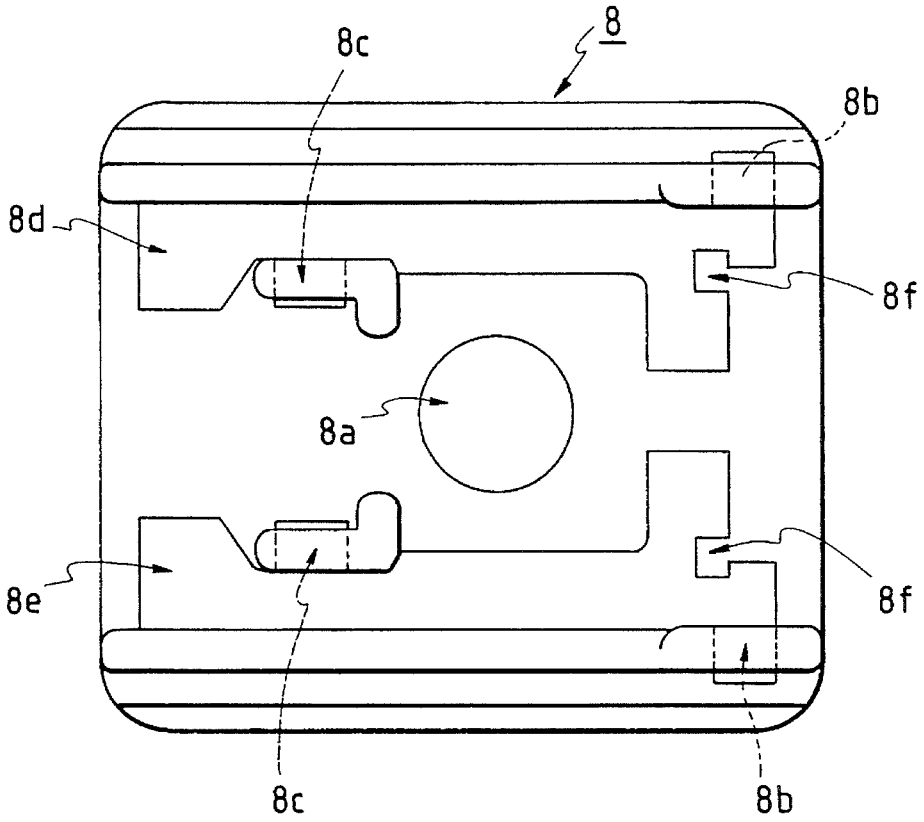
FIG. 6 is a plan view illustrating a baseplate provided in the push button switch.
Figure 7:
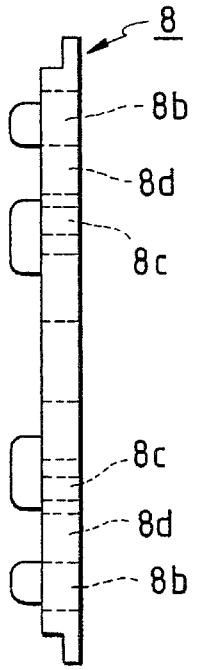
FIG. 7 is a side elevation illustrating the baseplate.

A first baseplate (housing) 8 formed of a synthetic resin is mounted on the support plate 1 such that the membrane sheet switch 2 is located between the support plate 1 and the housing 8. A key top 9, formed of the synthetic resin, is supported above the housing 8 by a link unit 11 (discussed below). The housing 8 is formed with an opening 8*a* above the movable contact 4. As shown in FIGS. 6 and 7, the housing also has a pair of pin receiving slots (engaging recesses) 8*b* facing inward and a pair of pin receiving slots (engaging recesses) 8*c* facing outward. As discussed below, these slots slidably receive pins (engaging protrusions) of the link unit 11.

As shown in FIG. 1, an elastic (rubber) click member 10 is placed on the housing 8 over the opening 8*a*. The click member 10 includes a skirted side wall 10*a* and a driving part 10*b* supported on this side wall 10*a*. The side wall 10*a* buckles (deforms) when the key top 9 is pressed downward by an operator. A clicking sensation is produced when the side wall 10*a* buckles. The side wall 10*a* of the click member 10 is provided along the circumference of the opening 8*a* of the housing 8, whereby the driving part 10*b* of the click member 10 is located above the movable contact 4.

Figure 3:
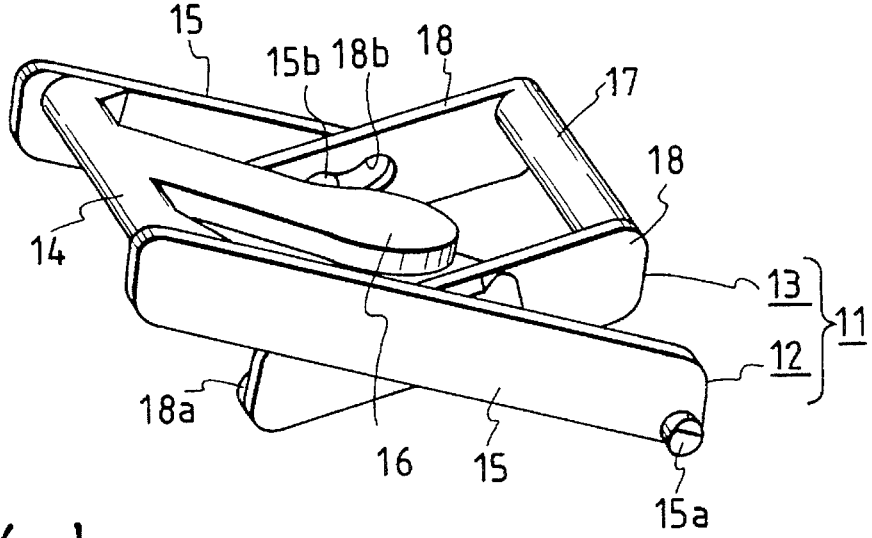
FIG. 3 is a perspective view illustrating arm members incorporated in the push button switch.
Figure 4A:
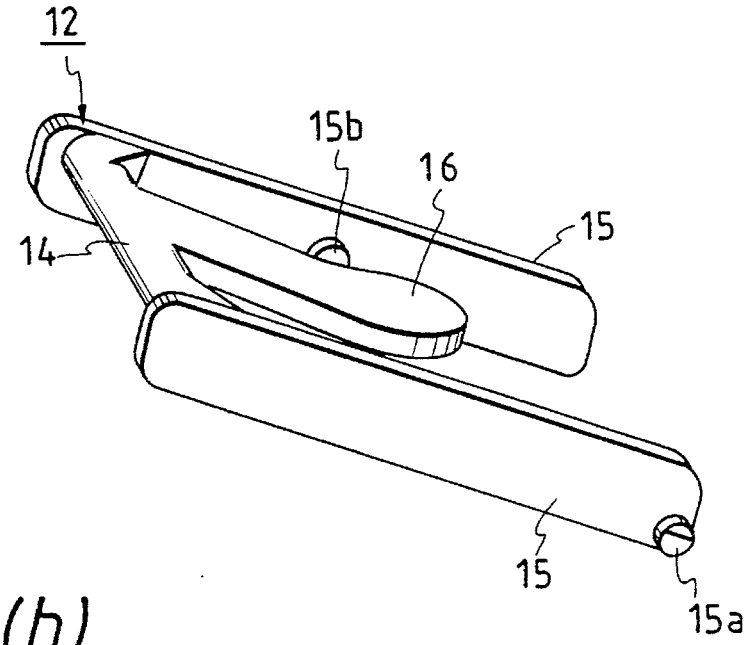
FIGS. 4(*a*) and 4(*b*) are perspective views showing each of the arm members of FIG. 3.
Figure 4B:
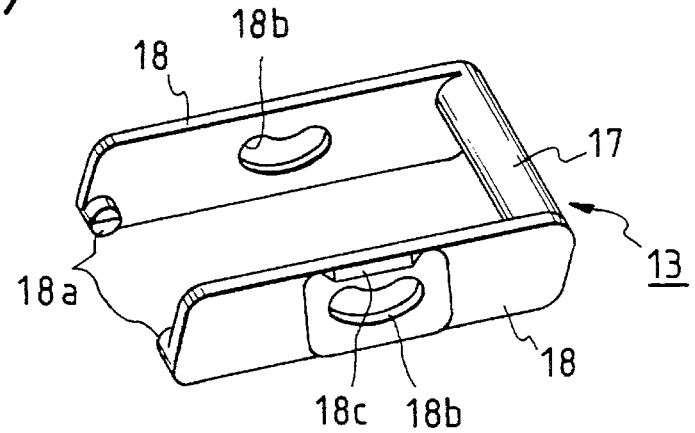
Figure 5A:
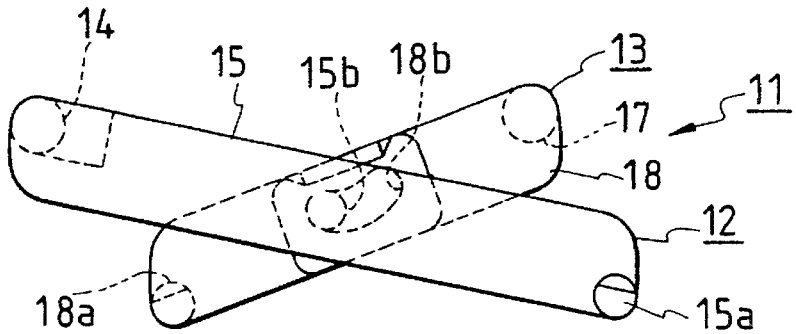
FIGS. 5(*a*), 5(*b*), 5(*c*) and 5(*d*) are explanatory views showing how the arm members operate.
Figure 5B:
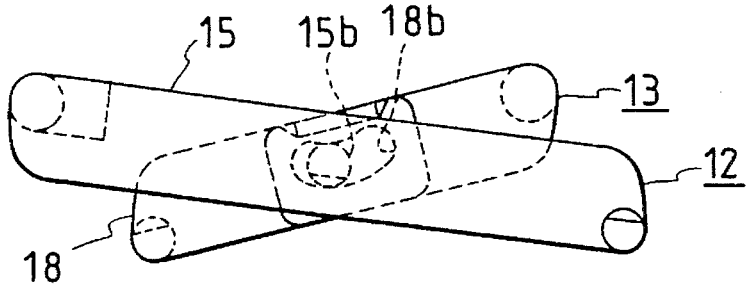
Figure 5C:
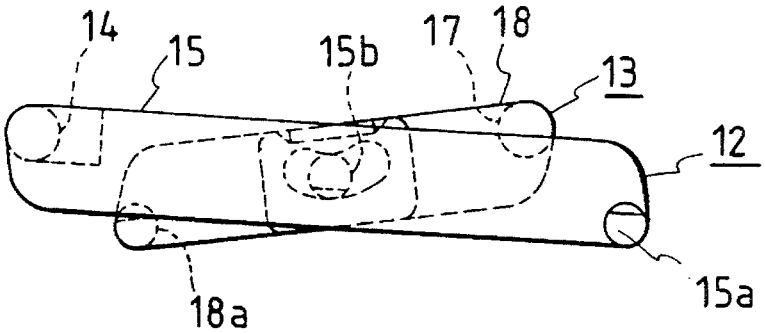
Figure 5D:
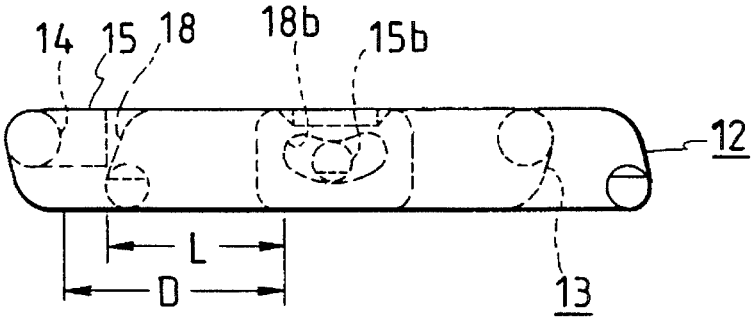

Referring to FIG. 3, a synthetic resinous link unit 11 includes a substantially E-shaped arm member (link member) 12 and a substantially U-shaped arm member 13. The link member 12 includes, as illustrated in FIG. 4(*a*), a pair of external legs (external leg pieces) extending in parallel from both ends of a shaft (support shaft) 14. The shaft 14 is intended to fixedly support one side of a rear surface of the key top 9. The external legs 15 have pins (engaging protrusions) 15*a* formed outward at the tips thereof and joints (connection pins) 15*b* facing inward and located substantially at the central portions thereof. In addition, a manipulation part 16, which is shorter than the external leg 15, extends from the center of the support shaft 14.

The manipulation part 16 is an elastic piece exhibiting some flexibility with respect to an external force acting in the moving direction of the key top 9. When the link unit 11 is incorporated into the housing 8, the tip of this manipulation part 16 is in constant elastic contact with a top face of the driving part 10*b* of the click member 10.

The other link member 13 includes, as shown in FIG. 4(*b*), a pair of internal legs (internal leg pieces) 18 extending from both ends of a shaft (support shaft) 17. When assembled with the link member 12, the internal legs 18 are received between the external legs (external leg pieces) 15. The shaft 17 serves to fixedly support the other side of the rear surface of the key top 9. The internal legs 18 have pins (engaging protrusions) 18*a* facing inward at the tips thereof and substantially heart-like (curved) slots 18*b* formed substantially in the central portions thereof. When assembled, the upper connection pins 15*b* of the link member 12 are loosely inserted in the slots 18*b*. The external leg 15 is connected to the corresponding internal leg 18 in such a way that the connection pin 15*b* is movable along the slot 18*b*. The two link members 12, 13 are united in this manner, thereby configuring the link unit 11.

The link unit 11 is thus constructed of the two link members 12, 13. The support shafts 14, 17 support opposite sides of the rear surface of the key top 9, which is biased away from the housing 8 by an elastic force generated by the click member 10. The external legs 15 and the internal legs 18 of the two link members 12, 13 are adjustably connected such that an angle at which they intersect each other can be varied. Hence, the key top 9 is held such that it is movable up and down without being tilted relative to the housing 8.

The following describes how the link unit 11 is constructed. The connection pins 15*b* are slidably held in the slots 18*b* at the intersections between the legs 15, 18 of the two link members 12, 13. Further, the engaging protrusions 15*a*, 18*a*, which are located on the tips of the respective legs 15, 18, are slidable with respect to the housing 8. The two link members 12, 13 are thereby pivotable between a raised position (shown in FIG. 1) and a depressed position (shown in FIG. 2) while maintaining a constant spacing between the two support shafts 14, 17. Thus, a support structure for fixing the key top 9 on the two-support shafts 14, 17 is attained. More specifically, for instance, if the two link members 12, 13 are assembled such that they only pivot about the intersections of the legs 15, 18, then a support structure would be required such that the key top 9 is slidable on the two link members 12, 13. This would require a complicated configuration of the rear surface of the key top 9 or an increase in its size. Nevertheless, as provided in the first embodiment, when the two link members 12, 13 are pivoted relative to the key top 9 without allowing sideways (sliding) displacement of the support shafts 14 and 17 relative to the rear surface of the key top 9, the configuration of the rear surface of the key top 9 may be, as illustrated in FIGS. 1 and 2, simple and small. This is due to the simple method by which the key top 9 is fixed to the support shafts 14, 17. The moldability of the key top 9 is therefore well and suitable for decreasing the thickness. Note that the key top 9 is snap-coupled to the link unit 11; this makes the assembling process easy. When the thus-held key top 9 is depressed by the operator, the support shafts 14, 17 of the two link members 12, 13 are forced downward. Then, as illustrated in FIGS. 5(*a*)–5(*d*), the external legs 15 and the internal legs 17, which are connected crosswise substantially in an X-shape, are arranged to gradually increase the intersecting angle as viewed from the key top 9. The two link members 12, 13 are thus pivoted to sequentially reduce a heightwise dimension of the link unit 11.

When the key top 9 is pressed, the two support shafts 14, 17 pivot (as described above) while the engaging protrusions 15*a*, 18*a* slide within the engaging recesses 8*b*, 8*c*. The external legs 15 and the internal legs 18, which are initially connected crosswise substantially the X-shape, cooperate to increase the intersecting angle as viewed from the key top 9. With this action, the manipulation part 16 moves downward against the driving part 10*b* of the click member 10. Consequently, just when the driving part 10*b* is lowered down to a predetermined height, the side wall 10*a* is buckled to produce a "clicking" sensation. At the same time, the driving part 10*b* is energetically forced downward and thus impinged on the upper sheet 3 of the membrane switch 2. As a result, a downward flexure is caused in the upper sheet 3, whereby the movable contact 4 contacts the fixed contact 6. This contact indicates that the push button switch is switched over from the off-state shown in FIG. 1 to the "on" state shown in FIG. 2.

Note that the connection pins 15*b* of the external legs 15 and the slots 18*b* of the internal legs 18 are mutually supplementally regulated in terms of their movements when pressing the key top 9 in this manner. That is, the connection pins 15*b* are guided by the peripheral walls of the slots 18*b* in terms of the movements in the directions orthogonal to the straight lines passing respectively through the rotational centers of the engaging protrusions 15*a* and the support shaft 14. Likewise, the slots 18*b* are regulated by the engaging protrusions 15*b* in terms of movements in the directions orthogonal to the straight lines passing through respectively the rotational centers of the engaging protrusions 18*b* and the support shaft 17. For this reason, the key top 9 supported on the respectively support shafts 14, 17 of the link members 12, 13 can be moved up and down while being maintained parallel with the housing 8 when the pressing manipulation force is imparted thereto.

Then, when the operator removes the pressing manipulation force applied on the key top 9, the buckled click member 10 is restored to its original configuration by its elasticity. The manipulation part 16 is therefore pushed up as the driving part 10*b* is lifted upward by the restored side wall 10*a*. Hence, the two folded link members 12, 13 rise to push up the key top 9 to the initial position shown in FIG. 1. Simultaneously, the upper sheet 3 flexes upward, and the movable contact 4 separates away from the fixed contact 6, thus returning the switch to the off-state.

As described above, the key top 9 is supported by use of the link unit 11 consisting of a combination of the link members 12, 13. The respective legs 15, 18 of the two link members 12, 13, which produce the variable intersecting angle in accordance with the height position of the key top 9, are regulated in terms of position in the housing 8. The key top 9 can be moved up and down straight without a guide wall that, as seen in the prior art, stands erect from the housing 8. Further, the present invention omits the prior art stem and sliding cylinder connection which can bind to hinder the up-and-down motions of the key top. Therefore, an extremely thin push button switch can be attained without causing a reduction in operability and reliability.

Further, the link unit 11 employed in the embodiment discussed above has one link member 12 provided with the manipulation part 16. When the operator depresses the key top 9, the manipulation part 16 pushes and drives the movable contact 4 through the driving part 10*b* of the click member 10. As such, the stem can be omitted from the rear surface of the key top 9. Further, the manipulation part 16 allows a shorter deformation (lowering) distance of the driving part 10*b* than an operation stroke of the key top 9. To be specific, the link member 12 including the manipulation part 16 rotates about the movable fulcrums provided at the tips of the external legs 15. However, a radius of rotation of the tip of the manipulation part 16 elastically contacting the top face of the driving part 10*b* is approximately one-half of a radius of rotation of the support shaft 14, which directly contacts the key top 9. A deformation distance of the driving part 10*b* may be therefore about one-half of the stroke length of the key top 9. In consequence, an amount of deformation of the click member when manipulated is reduced, thereby extending the life-span thereof. As such, the long-term high reliability can be maintained. Moreover, the radius of rotation of the tip, serving as a point of application, of the manipulation part 16 is approximately one-half of the radius of rotation of the fulcrum shaft 14 serving as a point of force. Based on the lever principle, even when the pressing manipulation force applied to the support shaft 14 is small, a large force is applied to the click member 10 by the manipulation part 16. Hence, there is such an advantage that the pressing manipulation force can be reduced. Besides, the manipulation part 16 is elastic in accordance with the first embodiment discussed above. After the intruding the driving part 10*b* of the click member 10 down to the stoke lowermost point, the manipulation part 16 becomes slightly flexural. Therefore, the push button switch is capable of, though extremely thin, providing sufficient overstroke to assure proper actuation of the switch while providing a desirable tactile feel.

Incidentally, the manipulation part 16, which is provided on the external link member 12, is brought into an elastic contact with the click member in accordance with the embodiment described above. However, the same manipulation part 16 may be provided on the inner link member 13; or the two link members 12, 13 can be biased upward by an elastic member other than the click member; or there may be adopted a manipulation part capable of directly push-driving the movable contact without the use of an elastic member.

Further, the dimensions of the link unit 11 are set such that pivoting of the internal legs 18 of the inner link member is not impeded by the support shaft 14 of the external link member 12. Specifically, as shown in FIG. 5(*d*), a distance D from the slot 18*b* to the support shaft 14 is set larger than a length L from the slot 18*b* to the tip of the internal leg 18. Accordingly, the two link members 12, 13 can be, as illustrated in FIG. 5(*d*), folded such that the external legs 15 and the internal legs 18 are located in a common plane. This therefore produces such an advantage that the lowermost stroke point of the key top 9 can be set to an extremely low position. This is in turn preferable for providing a much thinner push button switch.

Figure 8:
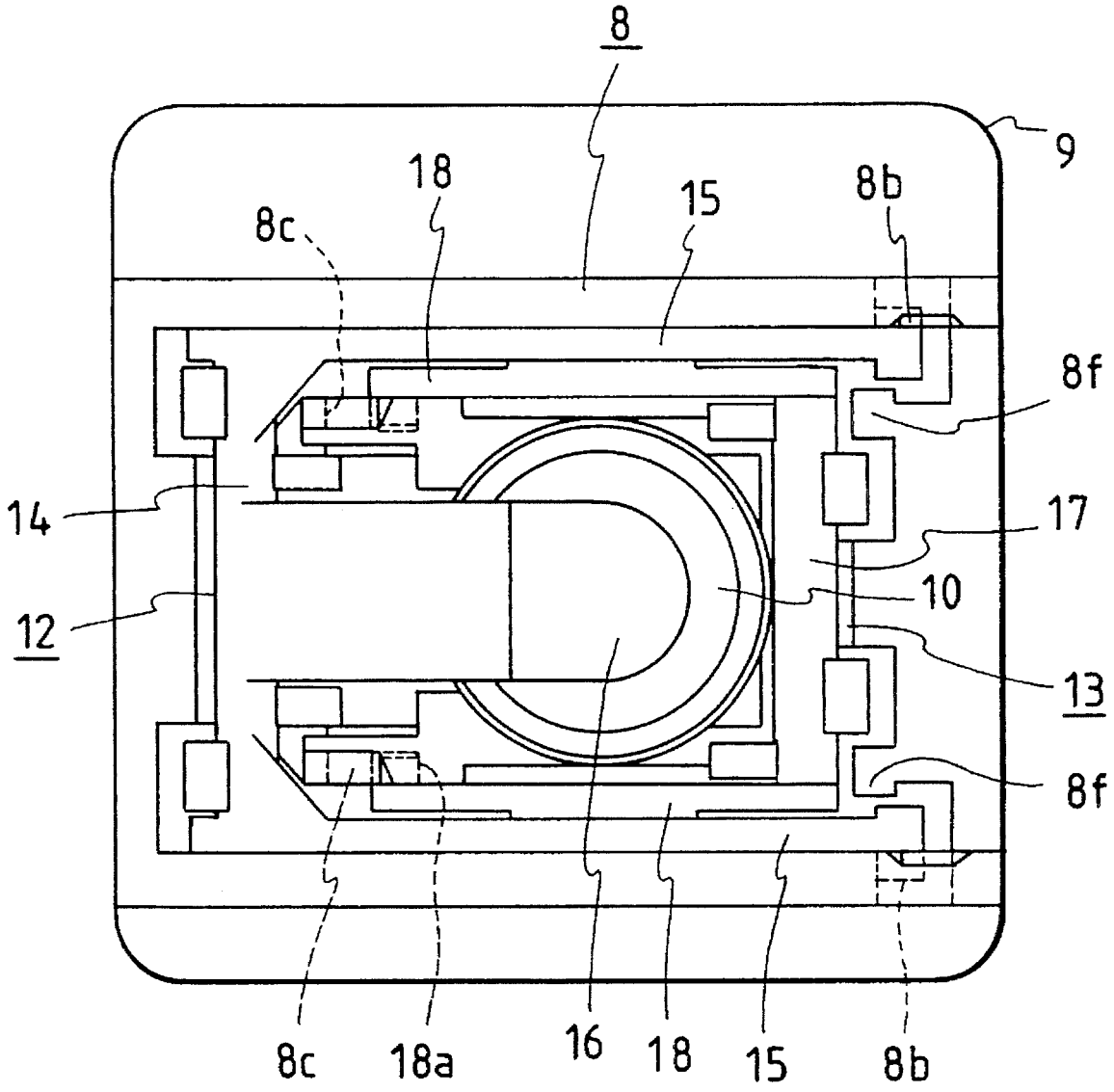
FIG. 8 is a plan view showing an internal structure of the push button switch in a first embodiment of this invention.

FIG. 6 is a plan view depicting the housing installed in the push button switch. FIG. 7 is a side elevation of the housing. FIG. 8 is a plan view showing how the key top support unit 11 is assembled in the housing. This housing 8 is formed with an opening 8*a* located above the movable contact 4 and a pair of leg receiving slots 8*d*, 8*e* disposed in a face-to-face relationship through this opening 8*a*. Further, two engaging recesses 8*b* and two engaging recesses 8*c* are respectively cut in the rear surface of the housing 8 on the side of the support plate 1. The two engaging recesses 8*b* communicate with respective external walls of the leg receiving slots 8*d*, 8*e*. The two engaging recesses 8*c* communicate with respective internal walls of the leg receiving slots 8*d*, 8*e*.

In addition, the housing 8 is, as shown in FIG. 6 provided with protrusions 8*f* obliquely opposite to the engaging recesses 8*b*. When mounting the link unit 11 in the housing 8, the back surfaces of the engaging protrusions 15*a* at the tips of the external legs 15 are in close proximity to the protrusions 8*f*. Therefore, even when a strong external force is applied, the engaging protrusions 15*a* are hard to disengage from the engaging recesses 8*b*.

When this link unit 11 is attached to the housing 8, the two external legs 15 are inserted in the leg receiving slots 8*d*, 8*e* from the surface side of the housing 8. The outward engaging protrusions 15*a* provided at the tips of the external legs 15 are inserted in the engaging recesses 8*b* formed in the rear part of the housing 8. At the same time, the two internal legs 18 are inserted in the leg receiving slots 8*d*, 8*e* from the surface side of the housing 8. The inward engaging protrusions 18*a* provided at the tips of the internal legs 18 are inserted in the engaging recesses 8*c* formed in the rear part of the housing 8. Thereafter, the housing 8 is placed on the support plate 15 mounted with the membrane switch 2, and these components are made integral. The openings of the engaging recesses 8*b*, 8*c* of the housing 8 are thereby blocked. It follows that the engaging protrusions 15*a*, 18*a* of the link unit 11 are slidably engaged with and held in the engaging recesses 8*b*, 8*c*, respectively. The external legs 15 and the internal legs 18 are regulated in position in the housing 8. Further, where the link unit 11 is thus incorporated in the housing 8, the driving part 10*b* of the click member 10, which is previously assembled in the housing 8, elastically contacts the tip of the manipulation part 16. Consequently, the support shaft 14 of the outer link member 12 is biased upward through this manipulation part 16. Simultaneously, it follows that the support shaft 17 of the inner link member 13 is also biased upward through the connection pins 15*b* of the link member 12. Moreover, the engaging recesses 8*b*, 8*c* are recessed in the rear surface of the housing 8. Further, the housing 8 is formed with the leg receiving slots 8*d*, 8*e* for receiving the legs 15, 18 of the link members 12, 13 at the lowermost stroke point of the key top 9. It is therefore possible to produce an extremely thin push button switch. Additionally, the engaging recesses 8*b*, 8*c* and the leg receiving slots 8*d*, 8*e* can be molded without using the undercut method. The housing 8 therefore becomes simple in configuration. It is feasible to reduce the costs by simplifying the molds for molding the housing 8. Further, when incorporating the link unit 11 into the housing 8, the legs 15, 18 are inserted in the leg receiving slots 8*d*, 8*e*, thus engaging the engaging protrusions 15*a*, 18*a* with the engaging recesses 8*b*, 8*c*. With such a simple operation, the switch is easy to assemble.

Besides, in the link unit 11 employed in the embodiment discussed above, the outward engaging protrusions 15*a* of the external legs 15 are engaged respectively with the inward engaging recesses 8*c* of the housing 8. The inward engaging protrusions 18*a* of the internal legs 18 are also engaged respectively with the outward engaging recesses 8*c* of the housing 8. Thus, the legs 15, 18 and thereby the two link members 12, 13, can be regulated in position relative to the housing 8. The external legs 15 and the internal legs 18 connected to each other at the intersections thereof are always regulated in position from the separating direction. Hence, the connections of these two sets of legs, 15, 18 are assured. At the same time, even when the strong external force is applied, the engaging protrusions 15*a*, 18*a* are hard to disengage from the corresponding engaging recesses 8*b*, 8*c*. Therefore, accidental disconnection of the link unit 11 from the housing 8 is prevented.

Figure 9:
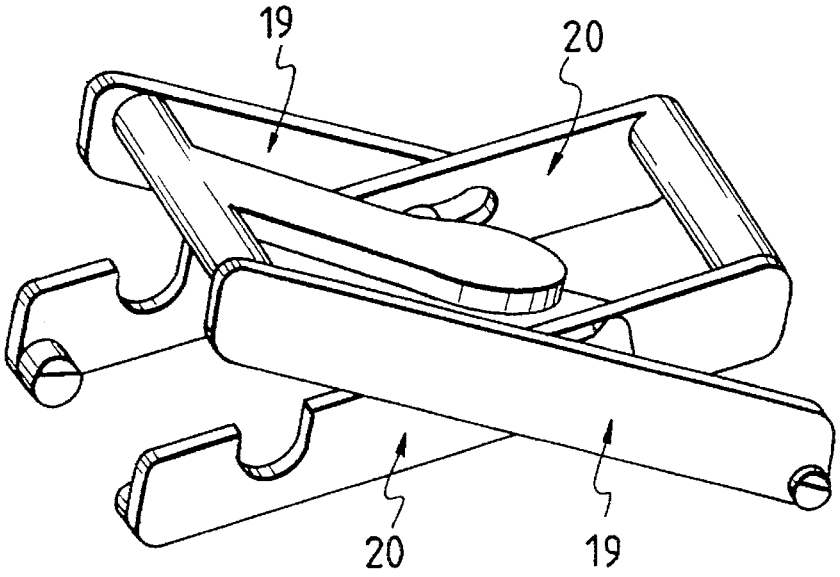
FIG. 9 is a perspective view showing a second embodiment of the arm members.

Note that the first embodiment described above has dealt with an arrangement where the length of each external leg of one link member 12 is set larger than that of the internal leg 18 of the other link member 13. The lengths of the two sets of legs 15, 18 are properly selectable. For instance, as illustrated in FIG. 9 by way of a second embodiment, the lengths of two sets of legs 19, 20 may be set substantially equal.

Figure 10:
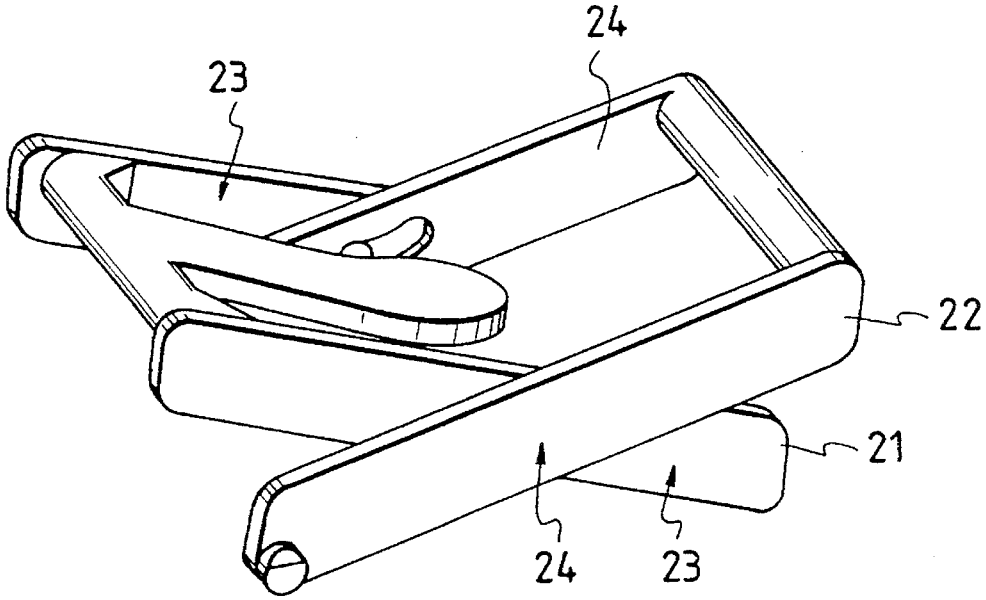
FIG. 10 is a perspective view showing a third embodiment of the arm members.

The first embodiment has also dealt with an arrangement where the external and internal legs 15, 18 are connected so that the two internal legs 18 of the other link member 13 are each located inwardly of the two external legs 15 of one link member 12. As illustrated in FIG. 10 by way of a third embodiment, however, two legs 24 of the E-shaped link member 22 may be located between the two legs 23 of the U-shaped link member 21.

Figure 11:
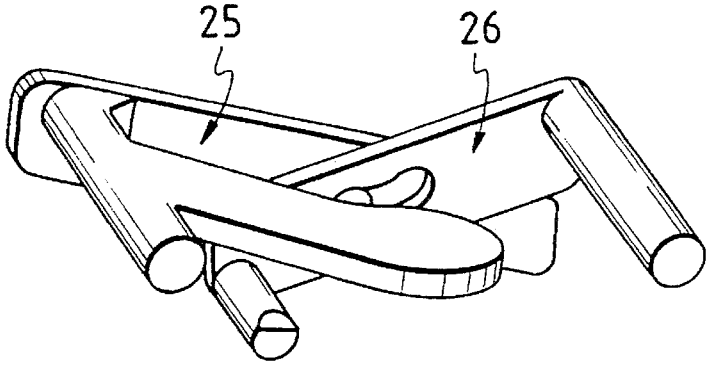
FIG. 11 is a perspective view showing a fourth embodiment of the arm members.
Figure 12A:
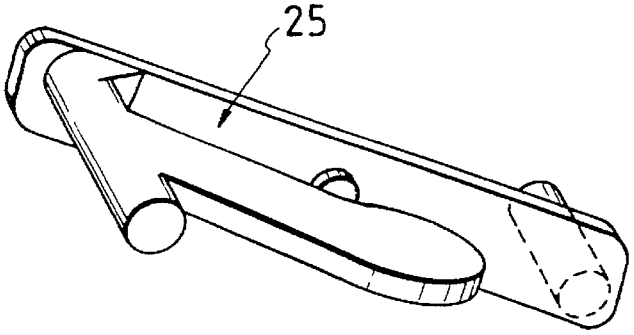
FIGS. 12(*a*) and 12(*b*) are perspective views of the arm members shown in FIG. 11.
Figure 12B:
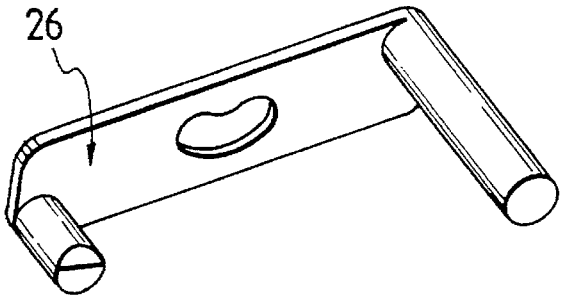

Further, it is not necessary to provide two legs on each of the link members. For example, as shown in FIGS. 11, 12(*a*) and 12(*b*), a possible arrangement is that one of the external legs 15 of one link member 12 and one of the internal legs 18 of the other link member 13 described in the first embodiment may be omitted; and a pair of remaining legs 25, 26 may be connected to constitute a link unit.

Figure 13:
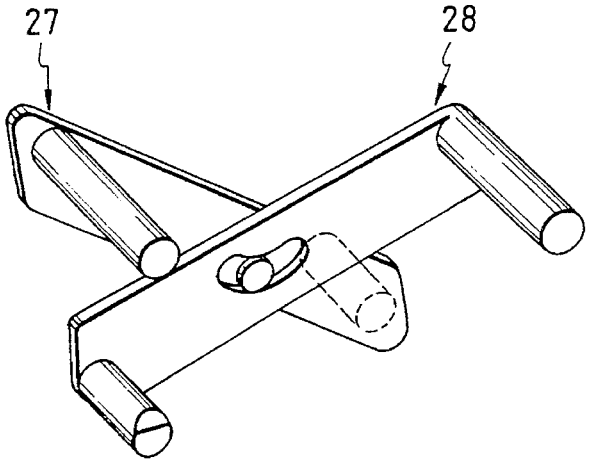
FIG. 13 is a perspective view showing fifth embodiment of the arm members.

Moreover, the embodiment discussed above dealt with an arrangement where the click member 10 is push-driven by the manipulation part secured to one link member. As shown in FIG. 13 by way of a fifth embodiment, two link members 27, 28 having no manipulation part are combined to constitute a link unit. The click member 10 can be also push-driven by a member other than this link unit, e.g., the rear surface of the key top 9.

Further, the configurations of the slots and the connection pins which serve to connect the legs of the two link members may be properly selectable. In converse to each embodiment described above, the connection pins may be loosely inserted in the slots from the interior. Further, the manipulation part formed on the link member elastically contacts the click member in each embodiment discussed above. However, the two link members may be biased upward by an elastic member other than the click member. Alternatively, there may be adopted a manipulation part capable of directly push-driving the movable contact without the use of an elastic member.

Moreover, other switches exhibiting the same effects as the above-mentioned embodiments are also possible, as will hereinafter be discussed in sixth and seventh embodiments.

Figure 14A:
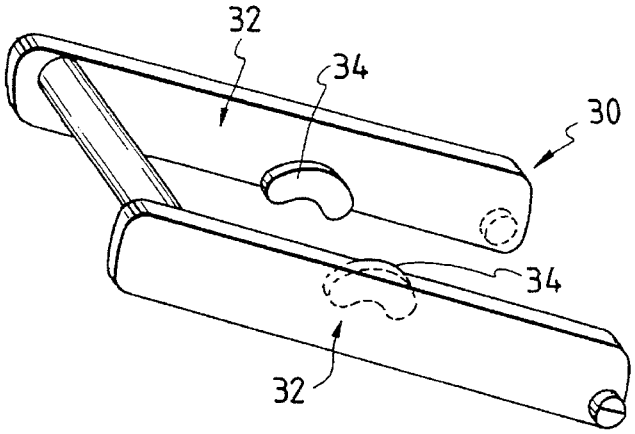
FIGS. 14(*a*) and 14(*b*) are perspective views showing a sixth embodiment of the arm members.
Figure 14B:
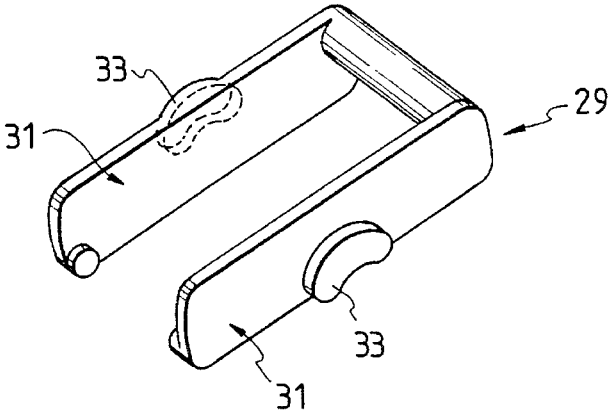
Figure 15A:
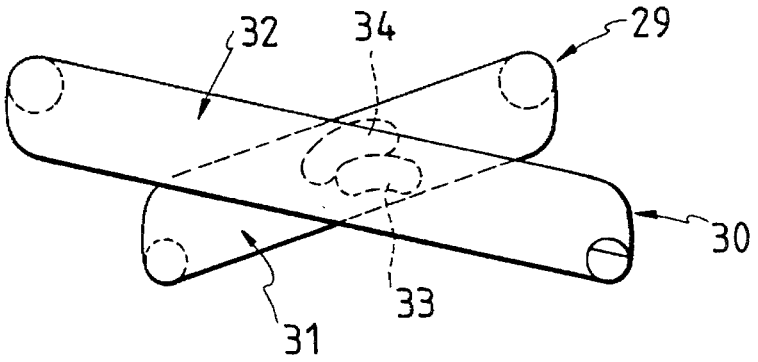
FIGS. 15(*a*)–15(*d*) are explanatory views showing how the arm members shown in FIG. 14 operates.
Figure 15B:
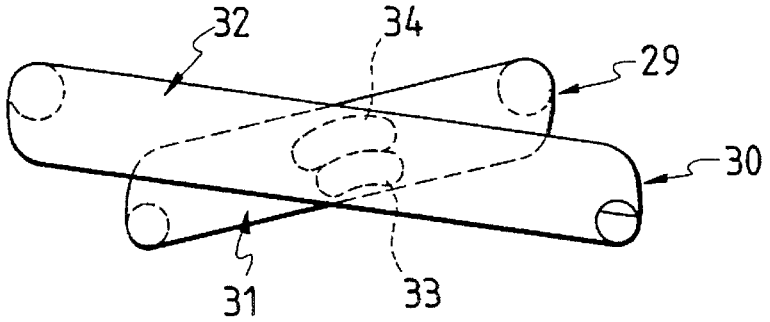
Figure 15C:
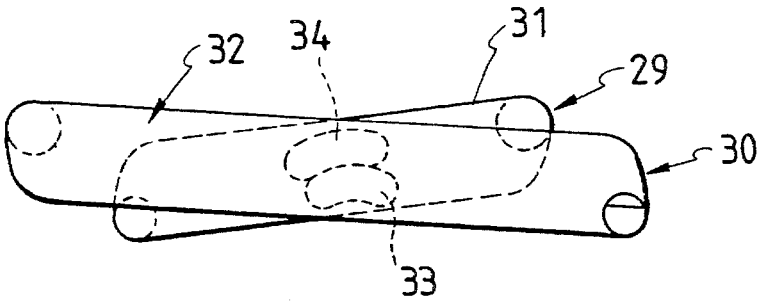
Figure 15D:
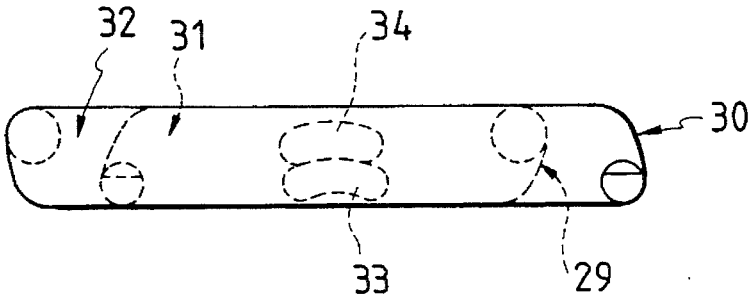
Figure 17A:
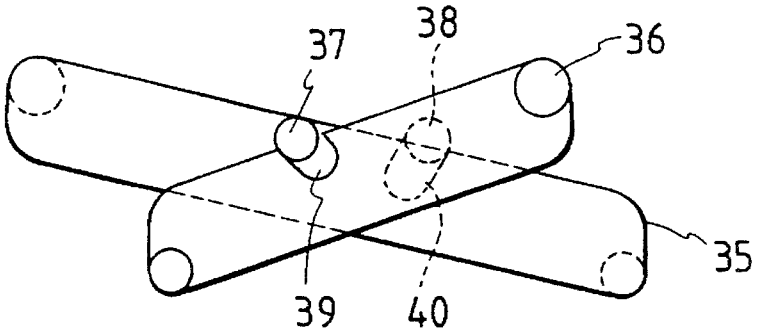
FIGS. 17(*a*), 17(*b*), 17(*c*) and 17(*d*) are explanatory views showing how the arm members shown in FIG. 16 operate.
Figure 17B:
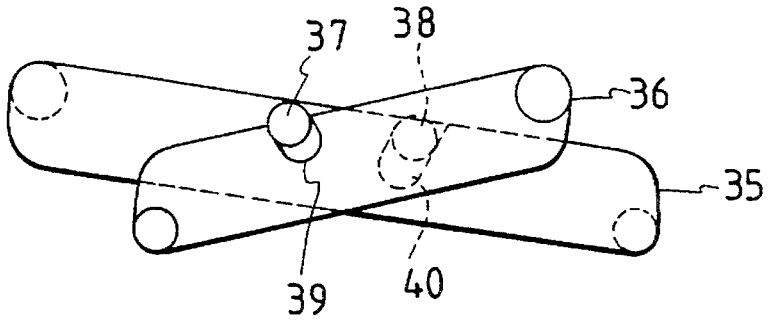
Figure 17C:
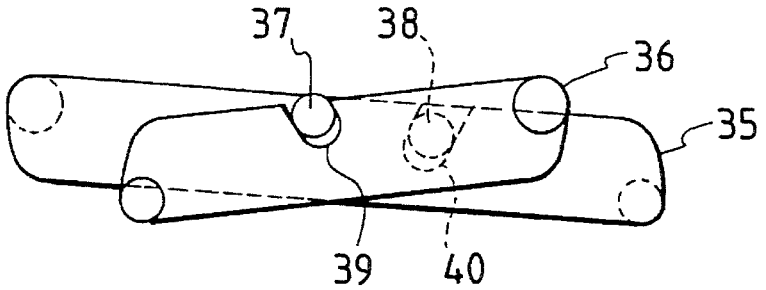
Figure 17D:
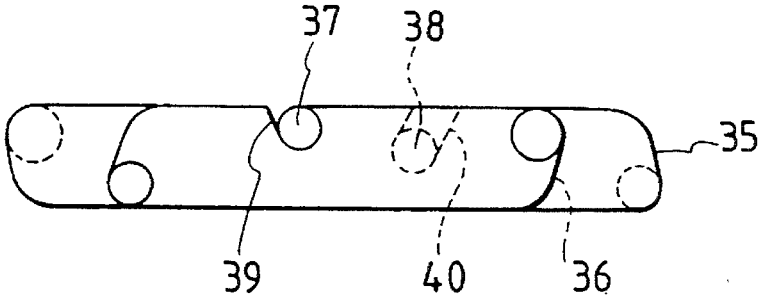

In accordance with the sixth embodiment shown in FIGS. 15(*a*)–15(*d*), heart-like protrusions 33, 34 are formed on respective legs 31, 32 of internal and external legs 29, 30 intersecting each other instead of the engagement of the connection pins 15*b* with the slots 18*b* shown in the foregoing first embodiment. Further, an up-and-down relationship between the two heart-like protrusions 33, 34 is reversed at two intersections. FIGS. 14(*a*) and 14(*b*) are perspective views illustrating the external legs 30 and the internal legs 29. FIGS. 15(*a*)–15(*d*) are explanatory views of operations of the thus constructed link members but show how the same operation is conducted as explained earlier with mutual contact-sliding of the heart-like protrusions 33, 34.

Next, in accordance with the seventh embodiment shown in FIGS. 16(*a*), 16(*b*) and FIGS. 17(*a*)–17(*d*), single legs 35, 36 intersecting each other are provided with connection pins 37, 38 and corresponding notches 39, 40. The pins and notches function similar to the pins and slots shown in the fourth and fifth embodiments. FIG. 16(*a*) is a perspective view showing the leg 35. FIG. 16(*b*) is a perspective view illustrating the leg 36. FIGS. 17(*a*)–17(*d*) are explanatory views of the operations of the thus constructed link member. The connection pins 37, 38 engage with the notches 39, 40, whereby the same operations as those described above can be performed.

In addition, as a matter of course, there can be properly selected the connection structure of the two link members, the support structure for the key top and the engaging structure with respect to the housing.

Finally, FIG. 18 is a sectional view of the push button switch in an eighth embodiment of the present invention in an off-state.

Turning to FIG. 18, a printed circuit board 50 has its surface provided with contacts 41. A housing 42 composed of a synthetic resin and a known click member 43 are mounted in sequence on this printed circuit board 50. A movable contact 44 is formed on the lower surface of this click member 43. The movable contact 44 and the fixed contacts 41 are disposed in the face-to-face relationship through an opening 42*a* formed in the housing 42. A switch element consists of these contacts 41, 44. Further, a key top 45 is so held as to be movable up and down above the housing 42. The numeral 46 designates a link member. This link member 46 includes engaging protrusions 47, 48 provided at both ends thereof and a manipulation part 49 at its center. The manipulation part 49 has some flexibility with respect to an external force acting thicknesswise of the plate. Then, the engaging protrusion 47 at the upper end of the link member 46 fixedly supports the rear surface of the key top 45. The engaging protrusion 48 at the lower end thereof is slidably engaged with an engaging recess 42*b* of the housing 42. The key top 45 is thus incorporated in the housing 42 through the link member 46. Further, in this incorporated state, the tip of the manipulation part 49 always elastically contacts the top face of the click member 43.

Accordingly, when the operator depresses the key top 45 by applying the pressing manipulation force thereon, the link member 46 is tilted in such a direction as to gradually reduce an angle of inclination. With this action, the manipulation part 49 thrusts down the top face of the click member 43, with the result that the a sense of clicking is induced just when the click member 43 is lowered by a predetermined quantity. At the same time, the movable contact 44 contacts the fixed contact 41, thus effecting a switchover from the off-state to the on-state. Moreover, when the operator removes the pressing manipulation force on the key top 45 in such an on-state, the buckled click member 43 reverts to its original configuration with the elasticity of its own. The manipulation part 49 is pushed up with an ascent of the click member 43. Consequently, the tilted link member 46 is lifted, thereby pushing up the key top 45 to the initial position. Simultaneously, the movable contact 44 is separated from the fixed contact 41, thus reverting to the off-state.

It is apparent that, in this invention, a wide range of different working modes can be formed based on the invention without deviating from the spirit and scope of the invention. This invention is not restricted by its specific working modes except being limited by the appended claims.

What is claimed is:

1. A push button switch comprising:

a key top having front and rear surfaces, and first and second shafting support parts formed on the rear surface;

a baseplate formed with third and fourth shafting part receiving slots;

a switch element made electrically conductive with up-and-down motions of said key top;

an elastic member, located between said key top and said baseplate, for biasing said key top away from said baseplate;

a first arm member including a first shafting part provided at a first end thereof, the first shafting part being rotatably connected to said first shafting support part of said key top, the first arm member also including a third shafting part provided at a second end thereof and slidably rotatably received in said third shafting part receiving slot, and a first joint part located between the first end and the second end; and a second arm member including a second shafting part provided at a third end thereof, the second shafting part being rotatably connected to said second shafting support part of said key top, the second arm member also including a fourth shafting part provided at a fourth end thereof and slidably rotatably received in said fourth shafting part receiving slot, and a second joint part located between the third end and the fourth end and rotatably slidably joined to said first joint part, said second arm member being connected crosswise to said first arm member at said second joint part;

wherein one of said first joint part and said second joint part includes a protrusion and the other of the first joint part and the second joint part includes a curved slot receiving said protrusion.

2. A push button switch comprising:

a key top having front and rear surfaces, and first and second shafting support parts formed on the rear surface;

a baseplate formed with third and fourth shafting part receiving slots;

a switch element made electrically conductive with up-and-down motions of said key top;

an elastic member, located between said key top and said baseplate, for biasing said key top away from said baseplate;

a first arm member including a first shafting part provided at a first end thereof, the first shafting part being rotatably connected to said first shafting support part of said key top, the first arm member also including a third shafting part provided at a second end thereof and slidably rotatably received in said third shafting part receiving slot, and a first joint part located between the first end and the second end; and a second arm member including a second shafting part provided at a third end thereof, the second shafting part being rotatably connected to said second shafting support part of said key top, the second arm member also including a fourth shafting part provided at a fourth end thereof and slidably rotatably received in said fourth shafting part receiving slot, and a second joint part located between the third end and the fourth end and rotatably slidably joined to said first joint part, said second arm member being connected crosswise to said first arm member at said second joint part;

wherein said first arm member includes said first shafting part and first and second legs connected to opposite ends of said first shafting part, the first and second legs being disposed in parallel in a face-to-face relationship to assume a substantially U-shape, each of the first and second legs including a third inward-facing shafting part received respectively in said third shafting part receiving slots, and wherein said second arm member is constructed of said second shafting part and third and fourth legs connected to said second shafting part and disposed in parallel in the face-to-face relationship to assume a substantially U-shape, said third and fourth legs being connected to outward-facing portions of said first and second legs of said first arm member, said third and fourth legs having fourth outward shafting parts received in said fourth shafting part receiving slots.

3. A push button switch comprising:

a key top having a front and rear surface and having first and second shaft supports formed on the rear surface;

a baseplate defining first, second, third and fourth slots;

a switch element positioned on the baseplate;

an elastic member, located between said key top and said switch element;

a first arm member including first and second parallel legs and a first shaft connected between first ends of the first and second legs, the first shaft being received by said first shaft support, the first arm member also having first and second protrusions formed at second ends of the first and second legs, the first and second protrusions being respectively received in said first and second slots, the first and second legs also defining first and second joint parts respectively located on the first and second legs between the first and second ends; and a second arm member including third and fourth parallel legs and a second shaft connected between first ends of the third and fourth legs, the second shaft being rotatably received by said second shaft support, the second arm member also having third and fourth protrusions formed at second ends of the third and fourth legs, the third and fourth protrusions being slidably and rotatably received in said third and fourth slots, the third and fourth legs also defining third and fourth joint parts respectively located on the third and fourth legs between the third and fourth ends;

wherein the first and third legs are connected by the first and third joint parts, and the second and fourth legs are connected by the second and fourth joint parts such that the first arm member and the second arm member form an X-shaped structure between the baseplate and the key top when the key top is positioned away from the baseplate, and the first arm member and the second arm member are collapsed into a common plane when the key top is pressed against the baseplate.

4. The push button switch according to claim 3, wherein each of the first joint part and the second joint part includes a protrusion, and each of the third joint part and the fourth joint part includes a curved slot receiving one of the protrusions.

5. The push button switch according to claim 3, wherein each of the third joint part and the fourth joint part includes a protrusion, and each of the first joint part and the second joint part includes a curved slot receiving one of the protrusions.

6. The push button switch according to claim 3, wherein the first arm member further comprises a manipulating part having a first end fixedly connected to the first shaft between the first and second legs, the manipulating part having a second end contacting an upper surface of the elastic member.

7. The push button switch according to claim 3, wherein the second arm member further comprises a manipulating part having a first end fixedly connected to the second shaft between the third and fourth legs, the manipulating part having a second end contacting an upper surface of the elastic member.

8. A push button switch comprising:

a key top having a front and rear surface and having first and second shaft supports formed on the rear surface;

a baseplate defining first, second, third and fourth slots;

a switch element positioned on the baseplate;

an elastic member, located between said key top and said switch element;

a first arm member including first and second parallel legs and a first shaft connected between first ends of the first and second legs, the first shaft being received by said first shaft support, the first arm member also having first and second protrusions formed at second ends of the first and second legs, the first and second protrusions being respectively received in said first and second slots, the first and second legs also defining first and second joint parts respectively located on the first and second legs between the first and second ends; and a second arm member including third and fourth parallel legs and a second shaft connected between first ends of the third and fourth legs, the second shaft being rotatably received by said second shaft support, the second arm member also having third and fourth protrusions formed at second ends of the third and fourth legs, the third and fourth protrusions being slidably and rotatably received in said third and fourth slots, the third and fourth legs also defining third and fourth joint parts respectively located on the third and fourth legs between the third and fourth ends;

wherein the first and third legs are connected by the first and third joint parts, and the second and fourth legs are connected by the second and fourth joint parts such that the first arm member and the second arm member form an X-shaped structure between the baseplate and the key top when the key top is positioned away from the baseplate, and the first arm member and the second arm member are collapsed into a common plane when the key top is pressed against the baseplate; and wherein said switch element is a membrane sheet switch consisting of an upper sheet having a movable contact and a lower sheet having a fixed contact facing said movable contact and brought into a contact with or separating from said movable contact, said membrane switch also including a spacer, disposed between said upper sheet and said lower sheet, for biasing said movable and fixed contacts apart from each other.

9. A push button switch comprising:

a key top having a front and rear surface and having a shaft support formed on the rear surface;

a baseplate defining a shaft receiving slot;

an elastic member, located between said key top and said baseplate, for biasing the key top away from said baseplate; and an arm member including a first shaft extending from a first end thereof, the first shaft being rotatably received by said shaft support, a second shaft extending from a second end of the arm member, the second shaft being slidably and rotatably received in said shaft receiving slot, and a manipulating part protruding from a central portion of the arm member and contacting an upper surface of the elastic member.

* * * * *